United States Patent [19]

Hahnewald et al.

[11] Patent Number: 4,816,645

[45] Date of Patent: Mar. 28, 1989

[54] METHOD FOR THE MANUFACTURE OF A HEATING UNIT

[75] Inventors: Andrea Hahnewald, Friedrichdorf; Richard Ebner, Waldems; Volker Ullrich, Hanau, all of Fed. Rep. of Germany

[73] Assignee: Braun Aktiengesellschaft, Kronberg, Fed. Rep. of Germany

[21] Appl. No.: 14,928

[22] Filed: Feb. 13, 1987

[30] Foreign Application Priority Data

Feb. 21, 1986 [DE] Fed. Rep. of Germany ..... 3605610

[51] Int. Cl.[4] ..... F24H 9/02

[52] U.S. Cl. ..... 219/345; 219/542; 338/330

[58] Field of Search ..... 219/345, 542, 93; 338/328, 329, 330, 288

[56] References Cited

U.S. PATENT DOCUMENTS

| | | | |
|---|---|---|---|
| 1,050,912 | 1/1913 | Bolling | 338/288 |
| 1,596,081 | 8/1926 | Coleman | 99/338 |
| 2,590,328 | 3/1952 | Koci | 99/389 |
| 2,659,799 | 11/1953 | Ireland | 219/542 |
| 3,534,148 | 10/1970 | Bange | 338/329 |
| 3,757,083 | 9/1973 | Dietz . | |

FOREIGN PATENT DOCUMENTS

| | | |
|---|---|---|
| 2217719 | 3/1973 | Fed. Rep. of Germany . |
| 2917808 | 1/1983 | Fed. Rep. of Germany . |

*Primary Examiner*—E. A. Goldberg
*Assistant Examiner*—L. Donovan

[57] ABSTRACT

The invention is directed to a method for the manufacture of a heating unit comprising an insulating body having a front and a back side, one or several heating conductors arranged on the front part of the insulating body, and contact and fastening elements. The heating conductors are connected to the insulating body by means of the contact or fastening elements. To manufacture single- and double-faced heating units in a common process, it is proposed that in a first operating sequence the contact or fastening elements are rigidly fixed together with the insulating body by means of anchoring arrangements and that in a second sequence the one or several heating conductors are contacted with the contact or fastening elements.

5 Claims, 2 Drawing Sheets

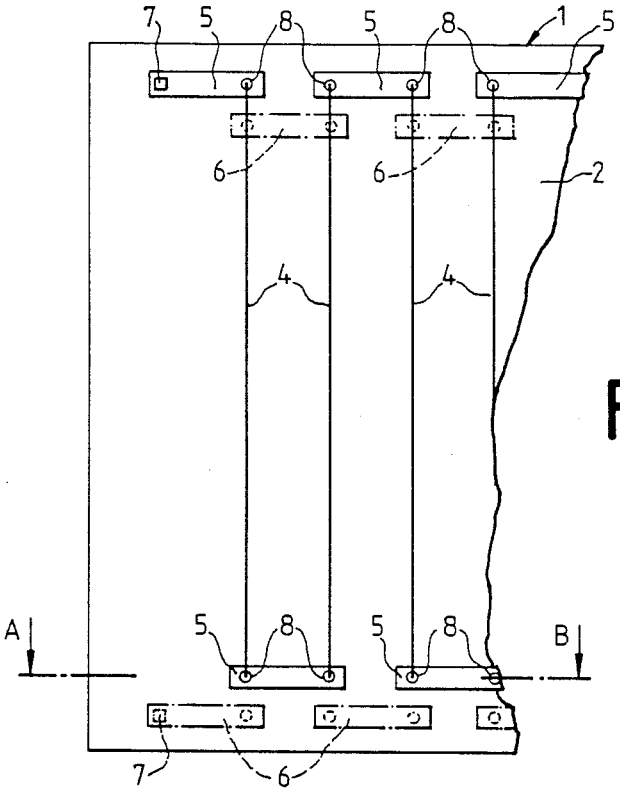
FIG.1
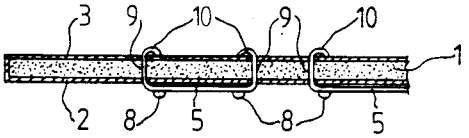
FIG.2
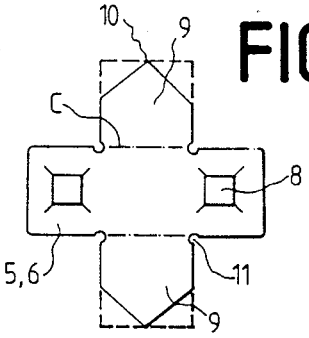
FIG.3
FIG.4
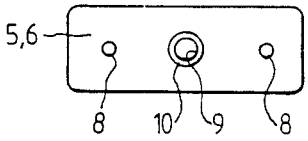

METHOD FOR THE MANUFACTURE OF A HEATING UNIT

This invention relates to a method for the manufacture of a heating unit, in particular for a bread toasting device (according to the preamble of patent claim 1.) The subject of the invention includes at the same time means for implementing this method.

From German Patent Specification No. DE-PS 2,917,808 a method for the manufacture of a heating unit for a bread toaster is known. The known heating unit is comprised of a plate-shaped body of insulating material having a front part and a back, wherein according to the manufacturing method the means for implementing the method provide several heating conductors mounted tight over the front face of the insulating body. To secure the heating conductors to the plate-shaped insulating body, contact or fastening elements in the form of metal strips are provided in two opposite edge areas of the insulating body. In a joint operation, the metal strips which extend along the entire length of the edge of the insulating body are welded to the heating conductors and severed multiple times, such that short connecting bridges are maintained between two heating conductors. In the same operation, the contact members at which the heating conductors are secured to the rails are bent in the direction of the heating conductors on the front part of the insulating body.

Thus, the connecting bridges serve to establish an electrical contact between two adjacent heating conductors, in addition to serving to secure the heating conductors to the insulating body. For this purpose, the edge of the insulating body is provided with suitable recesses and projections, with the connecting bridges rearwardly engaging the projections. Accordingly, the heating conductors are arranged to extend on the front face while the connecting bridges engaging the projections extend on the back of the insulating body. The known method thus permits the manufacture of a heating unit in which intricate winding processes of the heating conductor on the insulating body are avoided.

It is a disadvantage of the heating unit manufactured in accordance with the known method that the sections of material between two adjacent connecting bridges are removed, causing material to be wasted. Another disadvantage resides in the fact that the manner in which the heating conductors are fastened, which is by hooking the connecting bridges over the projections provided at the edges of the insulating body, causes displacement of the connecting bridges by a small amount when the heating conductors are turned on. This means that as the heating conductors are heated, they will expand in length, causing the connecting bridges to be displaced onto the free ends of the projections provided at the edges of the insulating body. However, the displacement of the connecting bridges — securely fastening the connecting bridges to the projections is not possible with this known method — also provides the desired effect of preventing the heating conductors from being lifted off when heated. Neither is it possible with this known method, at least it is extremely difficult, to manufacture a heating unit having its heating conductors mounted on both the front part and the back. To make a heating unit with a double-faced heating, it is thus necessary to resort again to the intricate winding process, the known method, in addition to incurring other disadvantages mentioned, being only suitable for use with single-faced heating units.

Further, U.S. Pat. No. 1,596,081 discloses a heating unit for a bread toaster in which the heating conductors are secured to the support of insulating material by means of hooks. It does not become apparent from this specification in which manner the heating conductors are connected to the hooks or how the hooks are connected to the support of insulating material.

Accordingly, it is an object of the present invention to provide a method for the manufacture of a heating unit which eliminates the disadvantages referred to in the foregoing and which enables both the front and the back of the heating unit to be equipped with heating elements.

According to the present invention, a method for the manufacture of a heating unit is provided, in particular for a bread toasting device, wherein in a first operating sequence contact or fastening elements are rigidly fixed together with the body of insulating material by means of anchoring arrangements. Only in a second sequence is or are the heating conductor or conductors connected to the insulating body in which in the prior sequence the contact or fastening elements were immovably formed. This means that the heating conductor or conductors is or are connected to the contact or fastening elements while the contact or fastening elements are in turn connected to the insulating body. The first operating sequence thus affords the advantage of permitting the contact or fastening elements to be formed in the insulating body without any material being wasted. In addition, fixing the contact or fastening elements rigidly in the insulating body has the advantage that the contact or fastening elements are held captive and that the manufacture of an integral part comprised of the insulating body and a plurality of contact or fastening elements is possible in an advantageous manner. Although the method of the invention provides two operating sequences, the manufacturing process of a heating unit is simplified as compared with the method in which heating conductors, contact or fastening elements and insulating body are all assembled in a single operation. Apart from simplifying the manufacturing process of a heating unit — obviating, for example, the provision of high positioning accuracies of simultaneously acting tools as required by state of the art techniques — the rigid mounting of the contact or fastening elements in the insulating body advantageously prevents displacement of the heating conductors in their fastening points on the contact or fastening elements relative to the insulating body as the heating conductors heat and expand. Equally advantageously, it is possible to provide for temporary storage of the insulating bodies with their contact or fastening elements mounted, prior to fitting the heating conductors. Further, the second sequence can be advantageously a welding operation executed, for example, by means of a laser in which single heating conductors are separated from a leaf-shaped structure and connected to the contact or fastening elements. The leaf-shaped structure may be a group of conductors made from a strip of sheet metal by means of etching, for example, and interconnected by connecting bridges. These bridges are then severed in a third sequence to be executed subsequent to the second sequence.

Further, it is considered to be within the spirit and scope of the present invention if in a reversal of the principle of the contacting sequence the contact or fastening elements are first connected to the heating conductor to be subsequently rigidly connected to the insulating body, with the heating conductors being preferably welded below the contact or fastening element. In this manner, the heating conductors are wedged in between the fastening element and the insulating body, preventing them from becoming detached, whereby an additional mechanical fastening is obtained. In a modification of the assembly method previously described providing for temporary storage of semifinished insulating bodies, it is also possible to execute the two succeeding operations within a very short time and without intermediate storage of the parts.

Means for implementing the method of the invention are characterized in the subclaims. The subclaims propose anchoring arrangements serving to secure the contact or fastening elements to the insulating body. According to one of these anchoring arrangements, the contact or fastening elements are provided with prong-type members having plastically deformable free ends. The plastic deformation of the free ends on the back of the insulating body ensures secure and rigid mounting of the contact or fastening elements in the insulating body. In a further embodiment of the means of the invention for implementing the method, an anchoring arrangement in the form of an adhesive bonding is proposed.

The present invention will be described in more detail in the following with reference to the accompanying drawings, in which:

FIG. 1 is a top plan view of the front part of a plate-shaped heating unit manufactured in accordance with the method of the invention;

FIG. 2 is a sectional view of the heating unit of FIG. 1, taken along the line AB;

FIG. 3 is a view of an embodiment of an anchoring arrangement with a contact or fastening element for the heating conductors;

FIG. 4 is a view of another embodiment of an anchoring arrangement;

Figure 5:
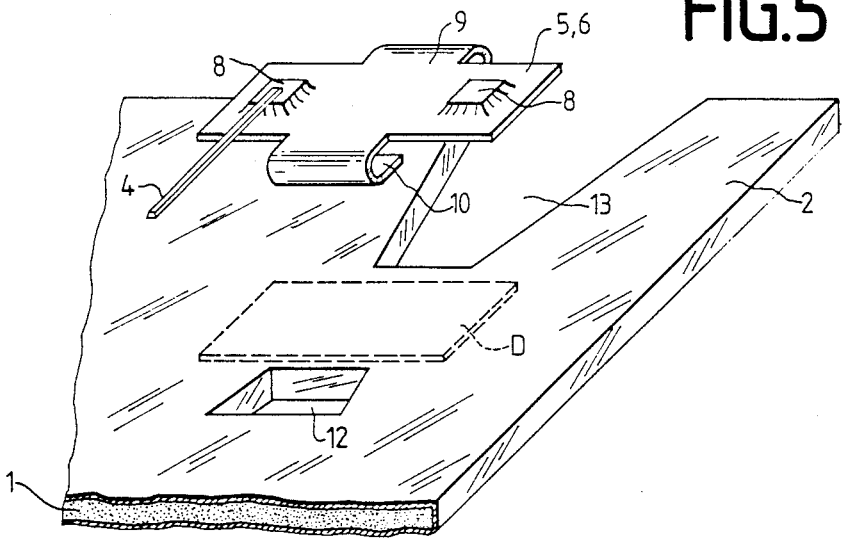
FIG. 5 is a perspective view of an anchoring arrangement with a contact or fastening element.

Referring now to FIG. 1, there is shown a body of insulating material of a plate-shaped heating unit as used, for example, in a bread toasting device. In the representation chosen, FIG. 1 shows the front part 2 of the insulating body 1 in a front elevational view. In two opposite edge areas of the insulating body 1, metallic contact or fastening elements 5 extending parallel to the edge will be recognized. The contact or fastening elements which are formed on the front part 2 of the insulating body 1 are identified by reference numeral 5 while the contact or fastening elements (shown in phantom) provided on the back side 3 are identified by reference numeral 6. Thus, the front part 2 corresponds at the same time to the back for the contact or fastening elements 6 if a double-faced heating unit is provided. The distinction between front and back of the insulating body 1 is made solely in the interest of a clearer description of the present invention. In FIG.1 only a part of the whole heating unit is illustrated, which explains why at the upper and lower edge only three and, respectively, two contact or fastening elements 5 are visible. Mounted tight between the contact or fastening elements 5 are heating conductors 4 connected to the contact or fastening elements in contact or support points. As becomes apparent from FIG. 1, one contact or fastening element 5 at the lower edge of the insulating body 1 lies opposite the space between two adjacent upper contact or fastening elements 5.

The described arrangement of the metallic contact or fastening elements 5 enables the individual heating conductors 4 between two opposite elements 5 to be electrically connected in series. Accordingly, current flows from an electrical terminal 7 via a first contact or fastening element 5, the contact or support point 8, the heating conductor 4, a further contact or support point and the lower contact or fastening element 5 to the next heating conductor 4. This results in the meander-shaped winding pattern shown in FIG. 1, with heat being radiated only by the heating conductors 4. The contact or fastening elements 5 are rigidly and immovably fixed together with the insulating body 1. This connection is accomplished in a first sequence while a second sequence provides for connection of the heating conductors 4 with the metallic contact or fastening elements 5 by spot welding, for example. Depending on the particular application, it is also possible to arrange the contact or fastening elements 5 and the heating conductors 4 on the insulating body 1 in a manner different from the one shown in FIG. 1. Thus, the contact or fastening elements 5 described so far serve an electrical function in that an electrical connection is established between two adjacent heating conductors 4, in addition to performing a mechanical function in that the elements 5 support the heating conductors 4 and connect them mechanically with the insulating body 1. In the following, the contact or fastening elements 5, 6 will only be designated as elements 5, 6, it being understood that an element 5, 6 may serve both the electrical and the mechanical function described above or only the mechanical function to be described hereinafter. In the absence of the electrical function of the elements 5, 6, the electrical function of the contact or support points 8 is usually no longer present either, so that in the following the contact or support points 8 will be designated as support points 8 only which, however, does not imply that they do not serve an electrical function.

The elements 5 are connected to the insulating body 1 by means of anchoring arrangements. For example, the anchoring arrangement may be a layer of adhesive bonding provided between the element 5 and the insulating body 1. In accordance with the method of the invention, single- and double-faced heating units can thus be manufactured by bonding first the elements 5 to the front face 2 or the back 3. In a modification of the method of the invention, it is, however, also possible to connect the heating conductors 4 first to the elements 5 and to subsequently affix the elements 5 to the insulating body by means of adhesive bonding or in a manner described hereinafter. As becomes apparent from FIG. 2 which represents a cross section of the heating unit taken along the line AB of FIG. 1, prong-type members 9 having free ends 10 may be substituted for the adhesive bonding to serve as anchoring arrangements. According to FIGS. 1 and 2, the elements 5 and the prong-type members 9 with their free ends 10 may be integrally formed, for example, in the form of a staple. To simplify the representation, the staple-type anchoring arrangements of FIG. 2 are illustrated as being provided only on the front part 2 of the insulating body 1. The free ends 10 of the staple-type anchoring arrangements of FIG. 2 are driven through the entire thickness of the insulating body 1, preferably protruding from the back 3 of the insulating body 1. To make the staple-type anchoring arrangements penetrate the insulating body 1, no holes are necessary, the prongs 9 being driven through the material of the insulating body 1. The free ends 10 which, for example, may also be pointed, are plastically deformable enabling them to be bent, as clearly shown in FIG. 2, such that undercuts are formed safely holding the elements 5, 6 captive in the insulating body 1. Also, the undercuts or plastically deformed free ends 10 contribute to retaining and fixing the fastening elements 5 in the insulating body 1 immovably and rigidly. The prong-type members 9 are apt to support this clinching action and rigid fastening if they are driven into the insulating body 1 without the provision of a hole. Securing the elements 5 in the insulating body 1 by means of the prong-type members 9 and the free ends 10 in a first operating sequence provides a component part affording ease of handling in terms of storage, with the heating conductors 4 being welded to the elements 5 in a second sequence. Apart from simplifying storage, the method of manufacturing a heating unit in two operating sequences as disclosed in the invention affords the advantage of requiring neither the elements 5 nor the heating conductors 4 to meet the high standards of positioning accuracy in the manufacturing process. If all parts identified are processed in a single sequence, the accuracy requirements made to the tool movements are a great deal higher, since the processes occur simultaneously. By contrast, in the manufacturing method of the invention it is sufficent for the elements 5 and the support points 8 to be within a specific tolerance range which may be varied, for example, by the form and width of the heating conductors and elements 5. Further, the method of the invention provides a simple way of producing heating units having their heating conductors 4 mounted on both the front part and the back side. In this embodiment, it is only necessary to prevent the elements 5 from contacting the elements 6 if the heating conductors 4 on the front part 2 are not to be connected in parallel with the heating conductors 4 on the back 3. To avoid such an electrical connection, the elements 6 are arranged in a spaced and/or staggered relationship to the elements 5 on the front part, as shown in FIG. 1. At the same time, the arrangement is selected such as to prevent contact between the free ends 10 and the heating conductors 4 on the opposite side of the insulating body 1. On the other hand, it is also possible to connect the heating conductors to the free ends 10 in the second operating sequence. In this embodiment, the elements 5, 6 essentially serve the electrical function described in the foregoing, the support points 8 and the free ends 10 being identical.

FIG. 3 is another embodiment of an integrally formed anchoring arrangement including prong-type members 9 and free ends 10. While in the staple-type anchoring arrangements of FIGS. 1 and 2 the prongs 9 are formed on the narrow sides of a rectangular element 5, 6, the prong-type members 9 of FIG. 3 are preferably arranged in the centers of the opposite long sides. Prior to being bent, the prong-type members 9 being bent along the line C preferably normal to the element 5, the integrally formed anchoring arrangement of FIG. 3 provides a cross-shaped structure with two crossbars. In the end areas of the one crossbar are the support points 8 while the other crossbar lying preferably at right angles thereto provides the free ends which may be pointed or, as shown in phantom outline, of rectangular shape. To allow better bending of the prong-type members 9, fillets 11 may be provided. As further indicated in FIG. 3, the support points 8 are comprised of hill- or plateau-shaped elevations preventing direct abutment between the heating conductors 4 contacting or secured to the support points 8 and the surface of the insulating body 1. In this embodiment, a relatively thin material may be used for the anchoring arrangement shown in FIG. 3. Preferably, two heating conductors 4 have their ends in contact at the support points 8, but it is also possible to align the anchoring arrangement of FIG. 3 such that for redundancy reasons a single heating conductor 4 is secured to the element 5 by two or several support points 8. In this event, the heating conductor 4 would extend longitudinally of the rectangular element 5, 6.

Further, FIG. 4 shows another embodiment of an anchoring arrangement comprised of an element 5, 6 in the form of a small rectangular plate which is riveted to the insulating body 1, not shown in FIG. 4, by means of a rivet. In this embodiment, the shank of the rivet corresponds to the prong-type member 9 and the free ends which are upset or plastically deformed, correspond to the free ends 10. The element 5, 6 may also be of another suitable form as described in the foregoing. For example, the element 5, 6 may be a circular disk. In the simplest form of embodiment, this circular disk is comprised of the pointshaped rivet itself, with the free ends 10 coinciding with the support points 8. In this manufacturing method, the rivet substantially serves only a mechanical fastening function provided that no electrical connection is to be made from the front part 2 to the back 3 of the insulating body 1. As another embodiment of prong-type members 9, needle-shaped pins are conceivable which, for example, are arranged and formed at the corner points or at the edge of the elements 5, 6. Further, it is not absolutely necessary for the free ends 10 to protrude from the opposite surface area of the associated element 5, 6 for plastic deformation and the formation of undercuts. On the contrary, plastic deformation of the free ends within the material of the insulating body 1 such that the element 5, 6 is safely secured will suffice. Moreover, all elements 5, 6 afford the manufacturing advantage of what is referred to as frame-type heating units — providing a wide opening in the insulating body 1 and requiring only one winding pattern for the heating conductors — since the elements 5, 6 are rigidly fixed together with the insulating body 1. Frame-type heating units can thus be built substantially more easily.

FIG. 5 is a perspective view of an insulating body 1 having a window 12 and an edge indentation 13 for insertion of an element 5, 6 of FIG. 3. The edge indentation 13 and the window 12 are of trapezoidal or conical configuration, with the shorter base sides of the trapezoidal cutouts 12, 13 facing each other. This results in centering forces when the prong-type members 9 are inserted and bent. This means that the element 5, 6 will be properly positioned automatically and without requiring an additional sequence as the prong-type members 9 are bent. The trapezoidal cutouts 12, 13 are also suitable for use with the elements 5, 6 shown in FIG. 1 in which embodiment only windows 12 would be provided. In this embodiment, the base sides of the trapezoidal windows 12 would be normal to the edge of the insulating body 1. Because of the windows provided, the element 5, 6 has its free ends 10 straight and, for improved clarity of representation, the element 5, 6 is shown as not assembled, so that the free ends 10 with their prong-type members 9 are not in engagement with the window 12 and the edge indentation 13. In fact, however, the element 5, 6 rests against the front part 2 of the insulating body 1 in the area identified by D and shown in phantom outline, the prong-type members 9 rearwardly engaging with their free ends 10 the back 3 of the insulating body 1. Further, FIG. 5 shows clearly the protruding support points 8 on the element 5, 6 for contacting the heating conductors 4. The hill-shaped elevations 8 may be embossed protuberances, for example. The edge indentation 13 helps to facilitate insertion and bending of the free end 10 of the prong-type member 9 on one side.

Figure 6:
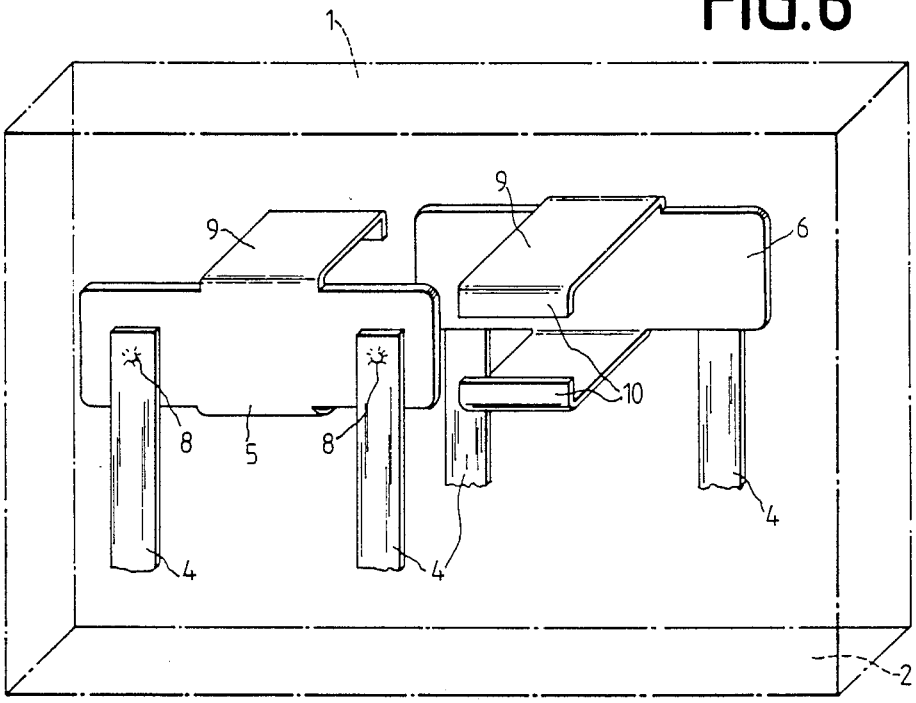
FIG. 6 is a perspective view of a heating unit with an anchoring arrangement on the front and back sides of the heating unit.

In a modification of FIG. 2, the prong-type members 9 of FIG. 5 extend parallel to the heating conductors 4 prior to being bent. As becomes apparent from FIG. 6 showing a perspective representation of a section of a double-faced heating unit, aligning the prong-type members 9 in this manner advantageously enables the packing density of the heating conductors on the front part and the back to be increased, even if the elements 5, 6 on the front and back are equidistantly spaced relative to the edge or lie on a common imaginary line. Further, this arrangement of the elements 5, 6 permits the necessary safety distance between the individual heating conductors to be maintained easily, and the arrangement of the winding pattern on the front part 2 and the back 3 of the insulating body 1 is identical. Advantageously, the elements 5, 6 can thus be further overlapped in the areas of the crossbars providing the support points 8, without the risk of an undesired electrical contact occurring between the heating conductors 4 on the front 2 and back 3. This side-by-side or, in the area of the support points 8, overlapping arrangement of the elements 5, 6 is not possible if the anchoring members formed on the narrow ends of the elements 5, 6 are mounted by the method shown in FIG. 2. As will be further seen from the perspective view of FIG. 6, the prong-type members 9 extend through the material of the insulating body 1 from the front to the back along its entire thickness. As described in the foregoing, the free ends 10 allow of suitable plastic deformation for clinching, fastening and undercutting purposes, being bent inwardly as shown in FIG. 6 by way of example.

Although in the examples described hereinabove reference has always been made to heating conductors 4 comprised of individual sections and extending from one element 5, 6 to another element 5, 6, it is possible in an equally advantageous manner to combine, in accordance with the method of the invention, complete winding patterns — produced, for example, by etching or stamping techniques — with an insulating body 1 to provide the desired heating unit. Thus, depending on the embodiments of the elements 5, 6 and the anchoring arrangements chosen, single- or double-faced heating units with different winding patterns can be formed.

We claim:

1. A plate shaped heating unit for use in a bread toasting device or the like comprising a planar insulating body having a front surface and a back surface, a plurality of metallic fastening elements secured on said insulating body, each said fastening element being a small plate that includes a body portion with two spaced contact points in the form of hill-shaped protuberances and a prong-type fastening portion, each said prong-type fastening portion extending through said insulating body, and having a free end that is deformed to secure its body portion to said insulating body, said plates being disposed in first and second spaced rows on one of said surfaces of said insulating body, the plates in said first row being disposed in offset relation to the plates in said second row, and a plurality of heating conductors disposed on said one surface of said insulating body, each said heating conductor extending along a straight path and having two ends, one end of each said heating conductor being welded to a hill-shaped protuberance of a plate in said first row and the other end of that heating conductor being welded to a hill-shaped protuberance of a plate in said second row, such that a series electrical interconnection of said heating conductors in serpentine configuration on said one surface of said planar insulating body is provided.

2. The heating unit of claim 1 wherein each said prong-type fastening portion has a free end that allows plastic deformation (5, 6) and has a length corresponding to the thickness of the insulating body .

3. The heating unit of claim 2, wherein said body portion and said fastening portion are an integrally formed element.

4. The heating unit of claim 3 wherein each said plate has two crossbars, said hill-shaped protuberances being on one crossbar and the second crossbar extending vertically to the first crossbar and providing the prong-type portion.

5. a plate shaped heating unit for use in a bread toasting device or the like comprising a planar insulating body having a front surface and a back surface trapezoidal cutouts disposed in first and second spaced rows on said insulating body with the shorter base sides of said trapezoidal cutouts facing each other, a plurality of metallic fastening elements secured on said insulating body, each said fastening element being a small plate that includes two spaced contact points in the form of hill-shaped protuberances, said plates being secured in said trapezoidal cutouts disposed in first and second spaced rows on said insulating body, the plates in said first row being disposed in offset relation to the plates in said second row, and a plurality of heating conductors disposed on said one surface of said insulating body, each said heating conductor extending along a straight path and having two ends, one end of each said heating conductor being welded to a hill-shaped protuberance of a plate in said first row and the other end of that heating conductor being welded to a hill-shaped protuberance of a plate in said second row, such that a series electrical interconnection of said heating conductors in serpentine configuration is provided on said one surface of said planar insulating body.

* * * * *